United States Patent [19]

Davies et al.

[11] Patent Number: 4,871,086

[45] Date of Patent: Oct. 3, 1989

[54] DISPENSING APPARATUS WITH PIVOTABLE ARTICLE CONTAINERS

[75] Inventors: Robert Davies, Stafford; John P. Johndrow, Wolverhampton, both of United Kingdom

[73] Assignee: Sankey Vending Limited, West Midlands, England

[21] Appl. No.: 246,656

[22] PCT Filed: Mar. 20, 1987

[86] PCT No.: PCT/GB87/00197

§ 371 Date: Sep. 12, 1988

§ 102(e) Date: Sep. 12, 1988

[87] PCT Pub. No.: WO87/05730

PCT Pub. Date: Sep. 24, 1987

[30] Foreign Application Priority Data

Mar. 21, 1986 [GB] United Kingdom ..... 8607059

[51] Int. Cl.[4] ..... G07F 11/06

[52] U.S. Cl. ..... 221/4; 221/6; 221/90

[58] Field of Search ..... 221/2, 3, 5, 6, 12, 221/14, 69, 87, 89, 90; 194/205, 212, 213, 254, 256, 258, 261, 277

[56] References Cited

U.S. PATENT DOCUMENTS

| | | | |
|---|---|---|---|
| 1,098,264 | 5/1914 | Jaeger et al. | 194/277 |
| 1,726,525 | 9/1929 | Clark . | |
| 4,024,954 | 5/1977 | Staar | 221/87 X |

FOREIGN PATENT DOCUMENTS

| | | |
|---|---|---|
| 0060643 | 9/1982 | European Pat. Off. . |
| 0205691 | 12/1986 | European Pat. Off. . |
| 3336619 | 4/1985 | Fed. Rep. of Germany . |
| 8525658.7 | 11/1985 | Fed. Rep. of Germany . |
| 2563985 | 11/1985 | France . |
| 841444 | 8/1985 | South Africa . |
| 2143662 | 2/1985 | United Kingdom . |

*Primary Examiner*—F. J. Bartuska

*Attorney, Agent, or Firm*—Marshall, O'Toole, Gerstein, Murray & Bicknell

[57] ABSTRACT

Apparatus for dispensing articles, particularly video tape cassettes, comprising a plurality of containers (26) for the articles and arranged in columns and having a transparent front panel to allow a user to identify the article therein. Each container being pivoted (42) and held closed by a latch (34, 47). Operation of the apparatus by a user selecting a container releasing the latch and allowing the container to be moved to an open position by a spring (53).

8 Claims, 3 Drawing Sheets

DISPENSING APPARATUS WITH PIVOTABLE ARTICLE CONTAINERS

This invention relates to article dispensing apparatus and in particular apparatus suitable for dispensing video tape cassettes. The apparatus is conveniently embodied in a vending machine which is capable of selling and/or renting such cassettes. However the dispensing apparatus has other applications.

According to one aspect of the invention we provide article dispensing apparatus comprising a row of substantially identical containers pivotally mounted side-by-side on a supporting structure, each container being in the form of a pocket closed at one end and open at the other and having a transparent front panel so that an article in the container can be seen by a user of the apparatus, each container being pivoted at a position adjacent the corner between its front face and its closed end to the structure so as to be pivotable between a closed position, wherein an article in the container is inaccessible, and in open position wherein an article can be removed from or replaced in the container by a user of the apparatus, latch means associated with each container to hold it in its closed position and operable to release the container to enable it to move to its open position, and control means operable by said user to operate a selected latch means to allow the associated container to move to its open position.

Other features of the invention will be clear from the following description and claims.

An embodiment of the invention will now be described in detail and by way of example with reference to the accompanying drawings in which.

Figure 1:
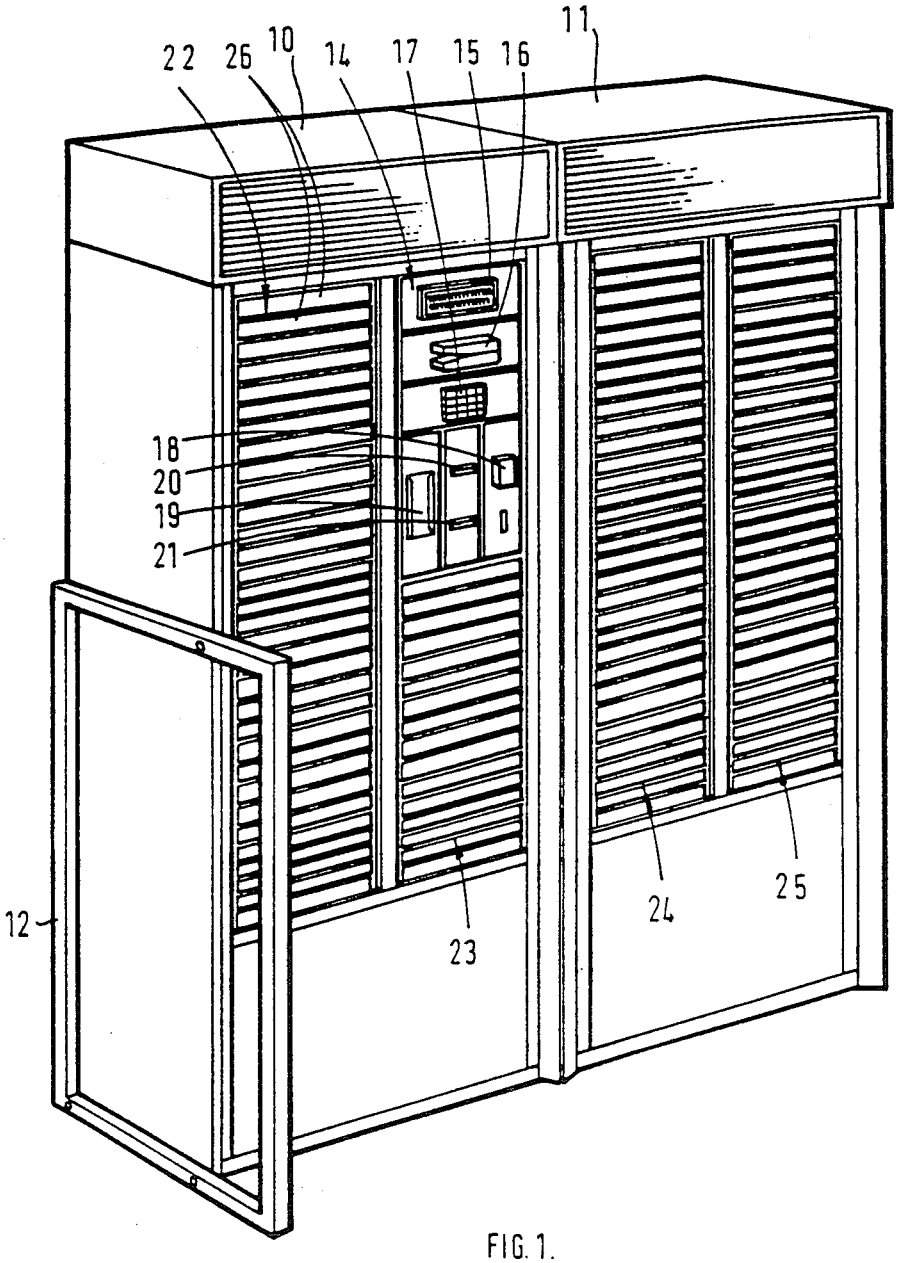
FIG. 1 is a perspective view of a vending machine embodying apparatus of the invention.

Referring now to FIG. 1, the vending machine there shown comprises a master unit 10 and a slave unit 11 which are connected together and are supported by a rectangular, framelike leg 12.

The master unit contains a control panel 14 which in turn contains a display 15, a wipe-through card reader 16, a key pad 17, a coinage receiver 18, a bar code reader 19, a card reader 20 for reading a credit card and a printer outlet 21.

The tape cassettes are received in columns of containers, there are four such columns of containers indicated generally at 22, 23, 24 and 25. The columns 22 and 23 are in the master unit and the columns 24 and 25 are in the slave unit. The columns are made up of modules of eight containers, each of the columns having four such modules except column 23 which has only two. The control and operation of all the containers is from the control panel 14. Additional slave units having additional columns of containers may be added to the right-hadn end of the assembly and controlled from the control panel 14.

Figure 2:
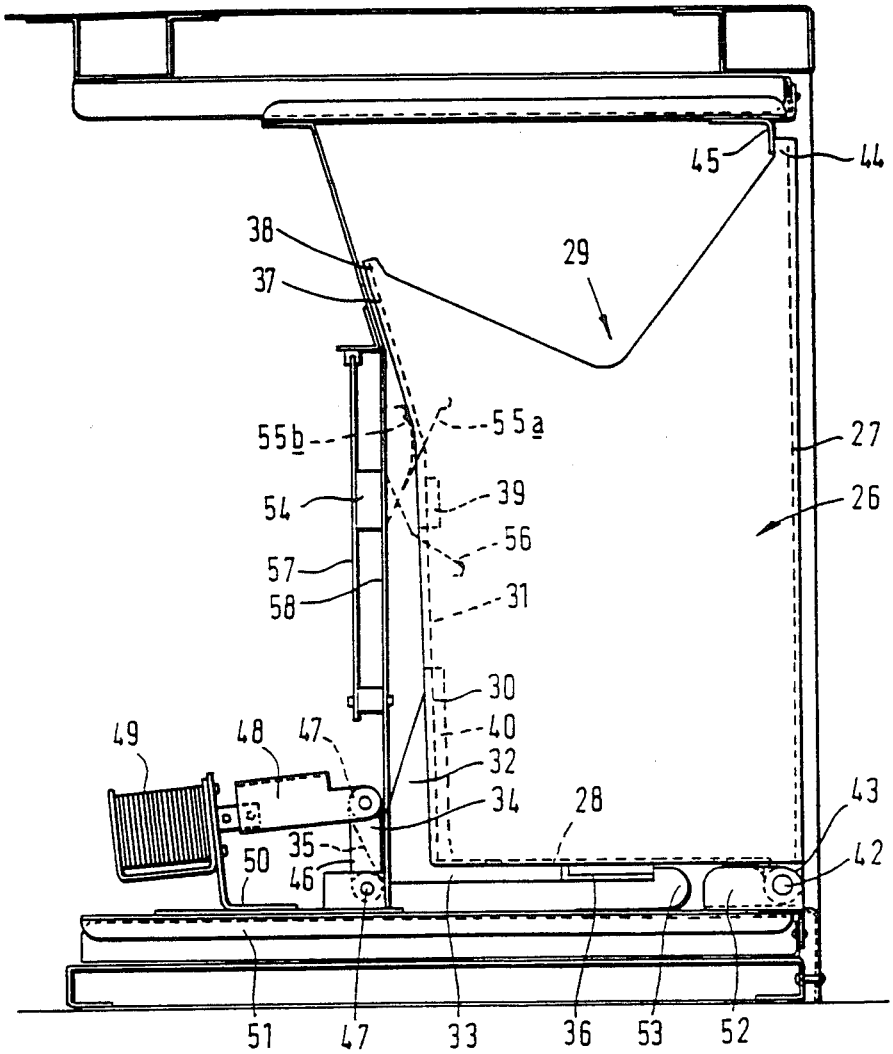
FIG. 2 is a section through one of the containers shown in FIG. 1.

FIG. 2 is a horizontal section through one of the columns 22 to 25 and shows a container 26.

Figure 3:
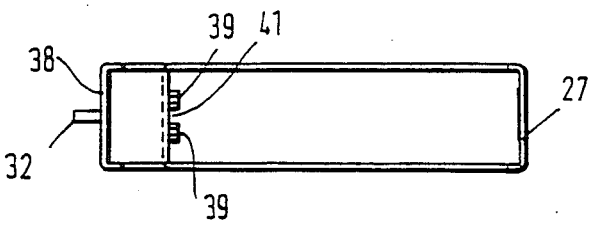
FIG. 3 is an end elevation of the container shown in FIG. 2.

The container is moulded from a high strength transparent plastic material and is in the form of a pocket of generally rectangular cross section as shown in FIG. 3. Thus the pocket has a transparent front face 27, a closed end 28 and an open end 29. The container has a back face 30 having an aperture 31 therein. A projection 32 in the form of a rib extends rearwardly from the back face 32 and is continued at 33 along the closed end 28. The rib has an abutment surface 34 nad an inclined surface 35. The rib extension 33 on the closed end terminates in a pocket 36. It iwll be seen that the open end 29 of the container is cut away so that an article received therein may be grasped when the container is open, as will be described, and that the rear face 31 diverges at tis upper end, in FIG. 2, as indicated at 37 ending in an abutment 38.

The rear face 30 is formed on its internal surface with pairs of ribs 38 and 40 on either side of the aperture 31 and these ribs provide a groove 41 between them as shown in FIG. 3. As shown in that figure the ribs taper from the closed end 28 towards the open end 29 to allow the moulding tool to be withdrawn.

The rear face 30 is formed on its internal surface with pairs of ribs 39 and 40 on either side of the aperture 31 and these ribs provide a groove 41 between them as shown in FIG. 3. As shown in that figure the ribs taper from the closed end 28 towards the open end 29 to allow the moulding tool to be withdrawn.

The pocket is pivoted about an axis which in use is vertical and is indicated at 42, the pocket being provided with an apertured lug 43 for that purpose. The container in FIG. 2 is shown in a closed position and has an abutment 44 which engages a fixed abutment 45 on the supporting structure of the unit.

The container isheld in a closed position by a pair of links 46 which are pivoted at 47 to the supporting structure and, at their upper ends in FIG. 2, are connected by a pin 47 which engages the abutment surface 34. Also secured to the pin 47 is a link 48 which in turn is connected to a solenoid 49. The link 48 is spring urged to the right in FIG. 2 so that the parts normally occupy the positions shown in that FIGURE. The solenoid is mounted at 50 on the supporting structure 51 which also carries a support 52 for the pivot axis 42.

A U-shaped spring 53 has one end received in the pocket 36 and the other end engages the structure 51. The arrangement is such that if the solenoid 49 is energised it pivots the links 46 in an anti-clockwise direction i nFIG. 2, the pin 47 comes out of engagement with the abutment surface 34 and the container is moved by the spring 53 to an open position in which the abutment 38 is midway between the position shown in FIG. 2 and the abutment 45. The customer may then open the container against the spring 53 until the abutment 38 engages the abutment 45. Release of the container results in the spring returning it to its midway position and then it may be closed by the customer. In the fully open position an article in the container can be removed or replaced.

The container is shut manually and as it is moved to its closed position the surface 35 engages the roller 47 and retracts the link 48 unti lthe container reaches its fully closed position whereupon the link 48 moves to the right in FIG. 2 and the pin 47 again engages the abutment surface 34 to hold the container in a closed position.

For each container there are two sensing means which comprise micro-switches and sensing arms. THe micro-switches are indicated at 54 and one of them has a sensing arm 55 which has a free position shown at **55*a***.

This arm senses whether or not a container is in its open or closed position by engaging the rear face 30 of the container as shown at 55*b*. The second micro-switch has an arm 56 which projects through the aperture 31 into the interior of the container as shown in FIG. 2 and can sense whether or not there is an article in the container.

If, after a container has been opened, it is not shut by the user of the apparatus, this will be sensed by the arm 55 which will disable the apparatus until the container has been shut.

The micro-switches are carried on a printed circuit board 57 secured to a plate 58. Each board 57 runs the whole length of a module of eight containers nad carries all the micro-swithces for the containers in the module.

The machine is designed to dispense video tape cassettes and it is important to the operation of the machine when used with such cassettes, that the name on the cassette can be read through the transparent front face 27 of the container. It is therefore important that the tape be placed in the container in an appropriate position.

Figure 4:
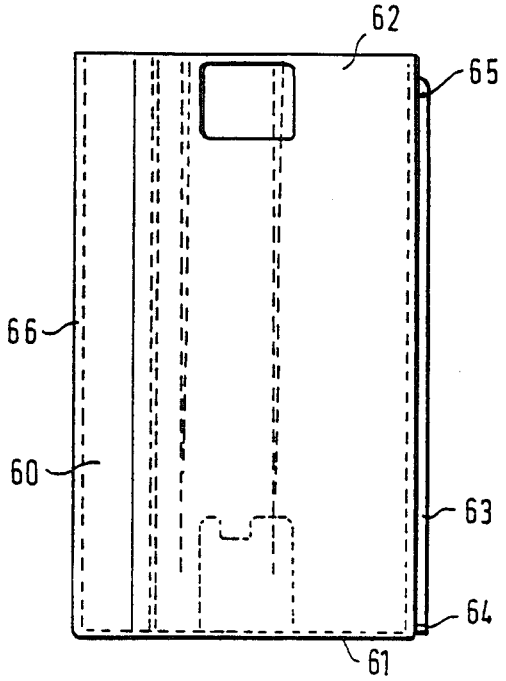
FIGS. 4 and 5 are plan and elevational views of a sleeve to receive a video tape cassette and capable of being received in oen of the containers.
Figure 5:
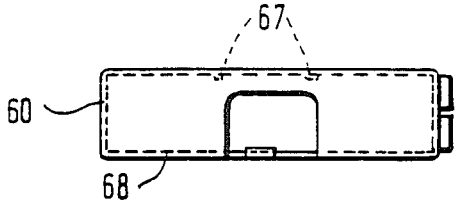

This is effected by having a transparent sleeve which is shown in FIGS. 4 and 5 which in turn contains the tape cassette, not shown, and which is so arranged that it will only fit into the container in one orientation. Moreover the cassette will only fit into the sleeve in one orientation.

Referring to FIGS. 4 and 5, the sleeve is indicated generally at 60 and is in the form of a pocket which has a closed end 61 and an open end 62. The sleeve is dimensioned to fit within the container 26 and is moulded from a similar transparent plastic material to that from which the container is made. The sleeve has an external rib 63 which is dimensioned to fit in the groove 41 and at one end of the rib 63 is an abutment 64. The other end 65 of the rib 63 is chamfered. It follows that the sleeve can only be inserted into the container when the end 65 of the rib 63 can be entered into the groove 41. It follows that the transparent front face 66 of the pocket will be behind the transparent front face 27 of the container and the name on the cassette can be read throughthe faces 27 and 66.

In use, a user can operate the machine with, for example, a pre-paid club card. The user will pass the club card through the card reader 16 and will identify himself. He may then selecte a container, the containers being numbered, by operating the key pad 17. THe container will then open because the control means will have controlled the appropriate solenoid 49 to pivot the links 46 to release the container which will then be opened bythe spring 53. The user will then remove the sleeve nad the cassette and will then close the container as described.

If the user fails to close the container then this will be sensed by the arm 55 of one of the micro-switches 54 and the machine will be disabled until such time as the container has been properly closed.

If the user selects a container which is empty this will be sensed by the switch 56 and an appropriate display will come up on the display 15 telling the user to select another container.

It will be appreciated that each of the containers in the columns or rows 22 to 25 will be arranged as shown in FIG. 2.

Instead of being supported on a leg such as 12 the apparatus may be secured toa floor or wall.

The invention provides apparatus for dispensing articles which is particularly useful in a vending machine for selling or renting video tape cassettes but may be used in other applications.

We claim:

1. Article dispensing apparatus comprising a row of substantially identical contaienrs pivotally mounted side-by-side on a supporting structure, each container being in the form of a pocket closed at one end and open at the other end and having a transparent front panel so that an article in the container can be seen by a user of the apparatus, each container being pivoted at a position adjacent the corner between its front face and its closed end to the structure so as to be pivotable between a closed position, wherein an article in the container is inaccessible, and an open position wherein anarticle can be removed from or replaced in the container by a user of the apparatus, latch means associated with each container to hold it in its closed position and operable to release the container to enable it to move to its open position, and control means operable by said user to operate a selected latch means to allow the associated container to move to its open position, the apparatus also comprising first sensing means to sense whether or not the container is in its open or closed position and second sensing means to sense whether or not there is an article in the container when it is closed, the control means being associated with the second sensing means and operable by said user to operate a latch means of a selected one of the containers if it contains an article to enable the container to move to its open position, and disabling means associated with the first sensing means which prevents operation of the control means to open a selected container if any one of the containers is not in its closed position.

2. Apparatus according to claim 1 wherein each container is spring biased towards its open position and held in its closed position by the latch means.

3. Apparatus according to claim 1 wherein the latch means comprises a member pivoted to the supporting structure and arranged in an operative position to engage a projection on the container when the latter is in tis closed position, the control means being arranged to pivot the member to an inoperative position out of engagement with the projection to allow a container to be opened.

4. Apparatus according to claim 3 wherein said member is spring biased to its operative position and the projection on each container is so shaped that, as the container is closed, the projection displaces the member to its inoperative position and when the container is fully closed the member springs back to engage the projection.

5. Apparatus according to claim 1 wherein when a container is in its closed position the end of the front face remote from the pivot engages an abutment on the supporting structure and when the container is in its fully open position a part of the rear face engages the said abutment.

6. Apparatus according to claim 1 wherein the container and an article received therein are pivoted with co-operating formations to ensure that the article can only be placed in the container in a single orientation.

7. Apparatus according to claim 6 wherein said formations comprise a co-operating groove and rib, the rib being arranged so that it can only enter the groove in one orientation.

8. Apparatus according to claim 7 wherein a transverse abutment is provided at one end of the rib to prevent that end being received in the groove.

* * * * *